United States Patent [19]

Herbert

[11] Patent Number: 4,467,476

[45] **Date of Patent: * Aug. 28, 1984**

[54] BULLET-PROOF GARMENT

[76] Inventor: M. Linton Herbert, 216 Harbor View Ln., Largo, Fla. 33540

[ * ] Notice: The portion of the term of this patent subsequent to Nov. 22, 2000 has been disclaimed.

[21] Appl. No.: 540,484

[22] Filed: Oct. 11, 1983

Related U.S. Application Data

[63] Continuation-in-part of Ser. No. 282,135, Jul. 10, 1981, Pat. No. 4,417,146.

[51] Int. Cl.[3] ..... F41H 1/02

[52] U.S. Cl. ..... 2/2.5; 2/51

[58] Field of Search ..... 2/2 R, 2.5, 48, 51, 2/2; 224/262; D3/32

[56] References Cited

U.S. PATENT DOCUMENTS

| | | | |
|---|---|---|---|
| 1,348,204 | 8/1920 | Brewster | 2/2.5 |
| 1,839,262 | 1/1932 | Quinn | 2/48 |
| 3,581,961 | 6/1971 | Owens | 224/262 |
| 3,946,916 | 3/1976 | Lawrence | 224/262 |
| 3,996,620 | 12/1976 | Maine | 2/48 |
| 4,013,201 | 3/1977 | Potter | D3/32 |

FOREIGN PATENT DOCUMENTS

| | | | |
|---|---|---|---|
| 744092 | 2/1956 | United Kingdom | 2/51 |

*Primary Examiner*—Louis Rimrodt
*Attorney, Agent, or Firm*—Cahill, Sutton & Thomas

[57] ABSTRACT

A garment is fabricated from a flexible, bullet-resistent material and includes an upper section, a lower section, and a weight transfer region. The upper section shields the wearer's torso while the lower section shields the wearer's hip and thigh areas. The weight transfer region is positioned adjacent to the wearer's upper hip area. The weight transfer region of the garment is secured to the wearer's hip area to transfer a substantial amount of the weight of the upper section of the garment to the wearer's hips.

12 Claims, 8 Drawing Figures

FIG. 5
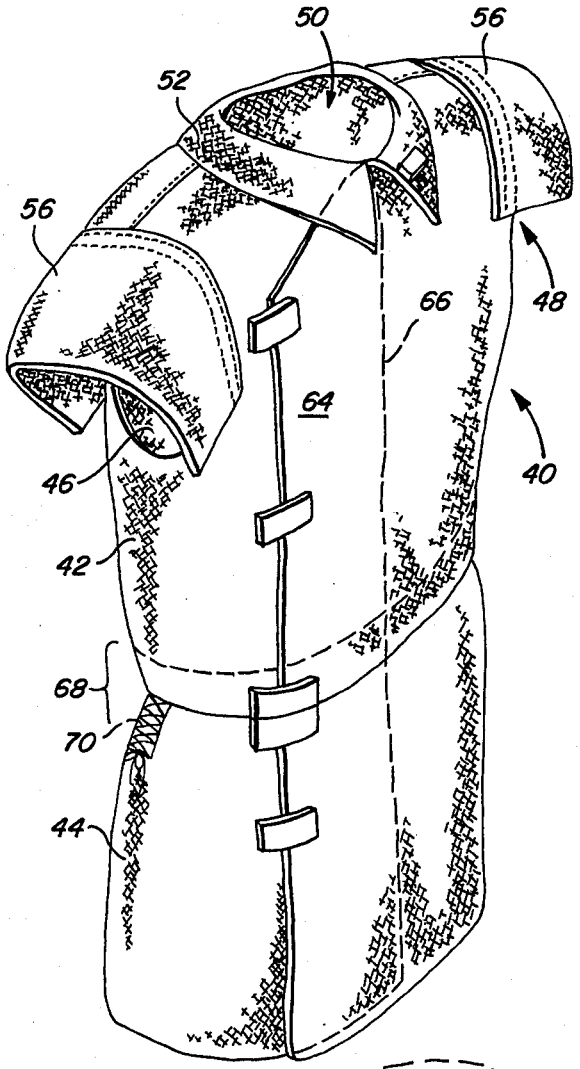
FIG. 6
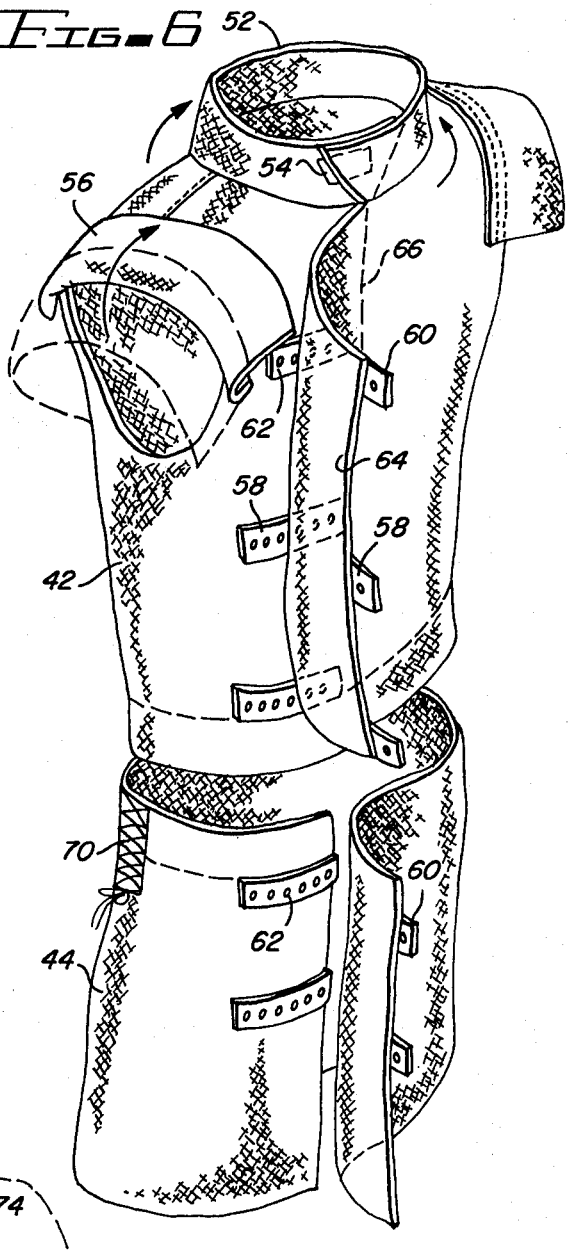
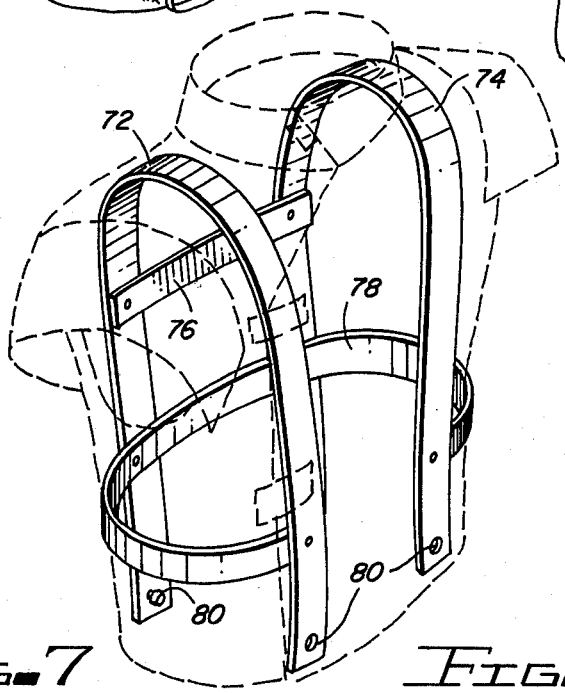
FIG. 7
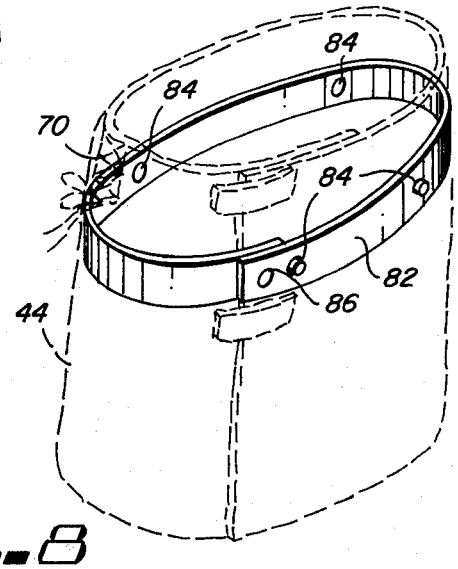
FIG. 8

BULLET-PROOF GARMENT

This application is a continuation-in-part of U.S. patent application Ser. No. 282,135, filed 7/10/81, now U.S. Pat. No. 4,417,146, granted Nov. 22, 1983.

BACKGROUND OF THE INVENTION

1. Field of the Invention

The present invention relates to bullet-proof garments, and more particularly, to flexible bullet-proof garments in which the weight of the upper section of the garment is supported primarily by the wearer's hips.

2. Description of the Prior Art

The prior art discloses a variety of different devices for supporting weight from a wearer's hips. U.S. Pat. No. 744,477 (Bush) discloses a body brace useful to a laborer or soldier for transferring the weight of a load to the wearer's hips. This device includes a pair of shoulder blades coupled to a collar in combination with a pair of spaced apart rigid stays. The stays are held against the wearer's body by first and second vertically spaced apart belts. A hip pad is coupled to the lower section of each stay. These elements function together to transfer the weight of a backpack type load to the wearer's hips.

U.S. Pat. No. 2,649,587 (Swearingen) discloses a shoulderless apron. A wire frame is coupled to the apron and surrounds the wearer's hip region. A portion of this frame extends into the upward front part of the apron to maintain that section of the apron in snug contact with the wearer's chest. U.S. Pat. No. 925,655 (Round) discloses an apron having a similar wire frame support which maintains both the front of the apron and a pair of shoulder straps in contact with the wearer's body.

U.S. Pat. No. 2,451,282 (Feibel) discloses an X-ray apron which includes a belt for supporting the lower portion of the apron from the wearer's hips.

U.S. Pat. No. 2,414,590 (Folb) discloses a strapless brassiere which includes a framework for maintaining the front of the garment in contact with the wearer's chest. This device avoids a requirement for shoulder straps by utilizing a hip-mounted belt section in combination with upwardly extending wire elements.

U.S. Pat. No. 1,298,618 (Wloszek) discloses a bullet-proof vest fabricated from a plurality of square armor segments. This device further includes a shoulder section and collar in combination with a belt. This device appears to utilize the wearer's shoulders as a primary support element.

U.S. Pat. No. 3,130,414 (Bailey) discloses a bullet-proof vest fabricated from a flexible material. U.S. Pat. No. 2,471,071 (McDonald) discloses another type of body armor.

U.S. Pat. No. 1,276,200 (Flanagan) discloses a bullet-proof garment which includes internally mounted shoulder straps and torso straps. This device also includes a head shield which includes structure for transferring a portion of the weight of the entire device to the wearer's head.

U.S. Pat. No. 2,404,255 (Green) discloses a protective apron having broadened shoulder straps to distribute the weight of the apron over the full width of the wearer's shoulders and a portion of the wearer's back. This apron also includes fixed position tie straps for securing the back wings.

U.S. Pat. No. 2,642,542 (Weinberg) discloses a radiation protective jacket which includes a semi-cylindrical body section having ends joined together by a zipper or vertically aligned snaps; or button. Two shoulder caps are coupled to the top of the body section to support and maintain the body section at a fixed position on the wearer.

U.S. Pat. No. 3,093,829 (Maine) discloses a protective apron having a high friction inner surface which causes the upper section of the apron to cling to the wearer's body across the shoulder region and permits the upper shoulder region of the apron to support the entire weight of the apron.

U.S. Pat. No. 2,494,664 (Lubow) discloses an X-ray protective apron having wide shoulder straps which surround the wearer's shoulders and distribute the weight of the apron over the shoulder area. This unique upper structure alleviates the need for retaining straps or tie straps.

U.S. Pat. No. 3,052,799 (Hollands) discloses a radiation protection garment which includes diagonal crossing flap members which overlap one another in the wearer's back region. This garment includes a fixed position tie string which is coupled to the diagonal crossing flap members.

U.S. Pat. No. 4,196,355 (Maine) discloses a two-piece radiation shield garment which includes vest and skirt sections.

SUMMARY OF THE INVENTION

It is a primary object of the present invention to provide a bullet-proof garment which is coupled to the wearer's body in a manner which permits the wearer's hips to support a large percentage of the weight of the upper section of the garment to significantly enhance wearer comfort and to reduce wearer fatigue.

Yet another object of the present invention is to provide a bullet-proof garment which includes first and second vertical stiffeners which are coupled to the garment and extend upward through a weight transfer region and the upper section of the garment to transfer the weight of the garment's upper section to the wearer's hips.

Still another object of the present invention is to provide a bullet-proof garment including a collar which can be displaced between a retracted position flat against the upper section of the garment and an extended position surrounding the neck of the wearer to partially shield the wearer's neck.

Yet another object of the present invention is to provide a bullet-proof garment which can be divided into first and second detachable parts coupled together by fastening means.

Briefly stated, an in accordance with one embodiment of the invention, a bullet-proof garment includes an upper section for shielding a wearer's torso. The upper section includes first and second apertures for the wearer's arms and a third aperture for the wearer's neck. A lower section of the garment shields the wearer's hip and thigh areas. A substantial amount of the weight of the upper section of the garment is transferred through a weight transfer region to the wearer's hips. First and second U-shaped, vertical stiffeners are coupled to the garment and extend upward through the weight transfer region and the upper section of said garment.

DESCRIPTION OF THE DRAWINGS

The invention is pointed out with particularity in the appended claims. However, other objects and advantages together with the operation of the invention may be better understood by reference to the following detailed description taken in connection with the following illustrations wherein:

FIG. 5 is a perspective view of a preferred embodiment of a bullet-proof garment incorporating the present invention.

FIG. 6 is a second perspective view of the bullet-proof garment depicted in FIG. 5, particularly illustrating the manner in which the garment is coupled together and the manner in which the garment can be divided into first and second parts.

FIG. 7 is a partially cutaway perspective view showing the internal support structure of the first part of the bullet-proof garment.

FIG. 8 is a partially cutaway perspective view indicating the internal support structure of the second part of the bullet-proof garment.

DESCRIPTION OF THE PREFERRED EMBODIMENT

In order to better illustrate the advantages of the invention and its contributions to the art, a preferred hardware embodiment of the invention will now be described in some detail.

Figure 1:
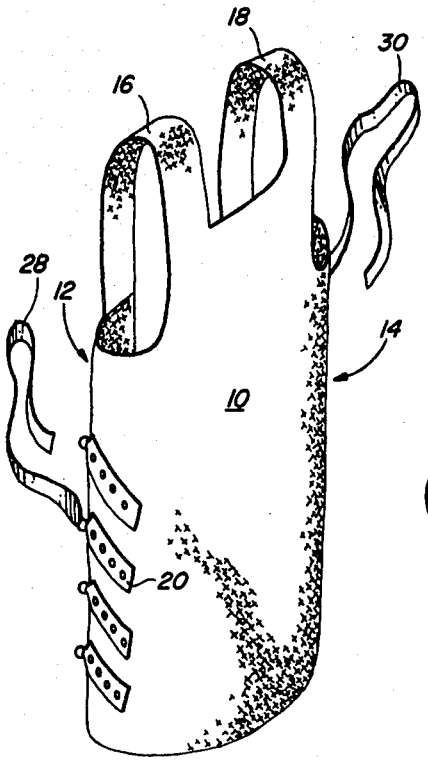
FIG. 1 is a perspective view of a preferred embodiment of an X-ray attenuating apron incorporating the present invention.
Figure 2:
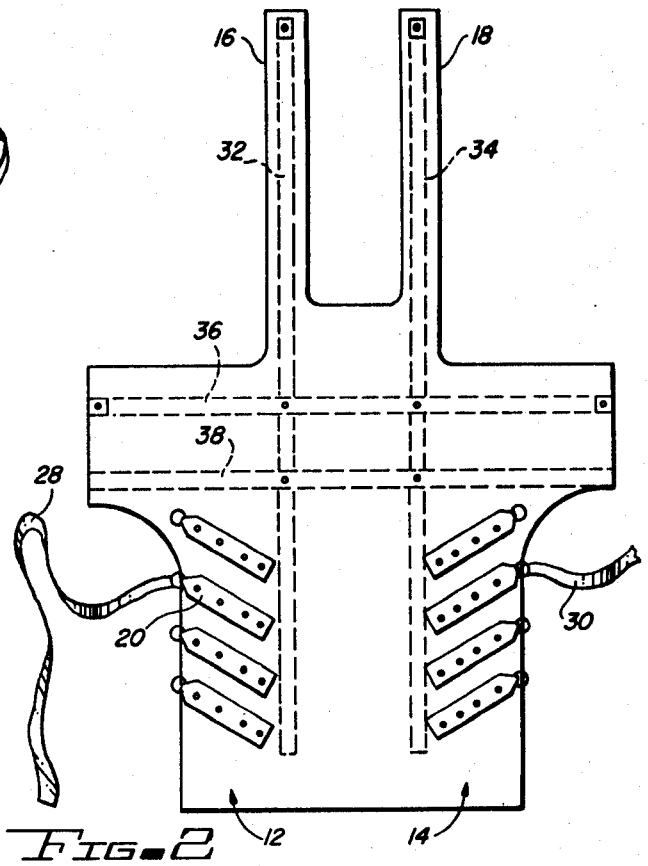
FIG. 2 is an elevational view of the X-ray attenuating apron depicted in FIG. 1, illustrating the apron in a flattened or spread out configuration.

Referring now to FIGS. 1 and 2, the X-ray attenuating apron of the present invention includes a body section 10 having a first side 12 and a second side 14. The apron also includes a first shoulder band 16 and second shoulder band 18.

Figure 3:
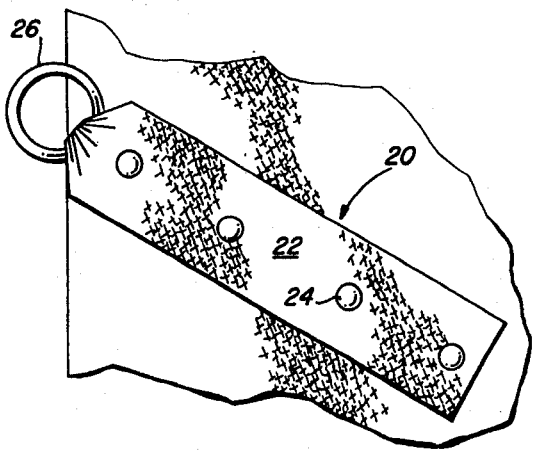
FIG. 3 is an enlarged elevational view of a single coupling element which permits one end of a tie strap to be coupled at an adjustable vertical position to the side surface of the apron body.

Apron body section 10 also includes coupling means which takes the form of first and second vertically aligned rows of coupling elements 20 which are secured along sides 12 and 14 of apron body section 10 within a weight transfer region. FIG. 3 is an enlarged view of a single coupling element 20.

Coupling element 20 includes a reinforcing strip 22 which is secured at an angle to the outer surface of apron body section 10 by a plurality of fastening means such as a rivet 24. The upper end of reinforcing strip 22 includes a coupling ring 26 or another equivalent form of securing means such as a clip, a snap, or a Velcro coupling system.

Tie straps 28 and 30 each include securing means positioned on one end which enables that end of the tie strap to be readily attached to and detached from coupling ring 26. In the preferred embodiment of the invention, this securing means may take the form of a clip or a hook which readily permits tie straps 28 to be coupled to or detached from coupling rings 26 which forms a part of the two vertically aligned rows of coupling elements 20. Tie straps 28 and 30 may be fabricated in any desired configuration, but to maximize the support and weight transfer advantages of the present invention these tie straps should be fabricated with a width of approximately 2–3 inches as is commonly utilized in aircraft and automotive seat belts. The increased width of tie straps 28 and 30 maximizes the area over which the apron body section 10 is coupled above the wearer's hip region and not only increases the effective weight transfer but also increases wearer comfort.

Figure 4:
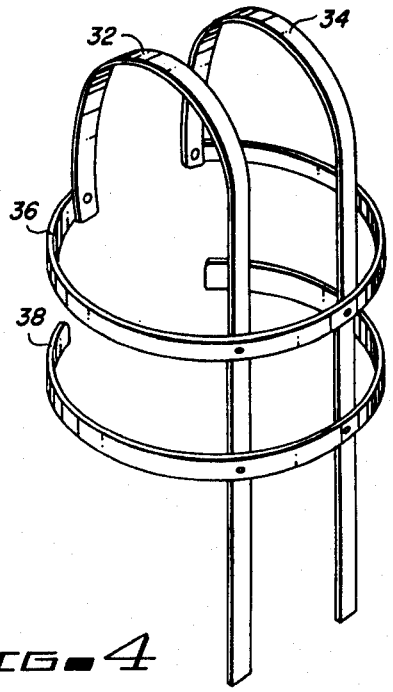
FIG. 4 is a perspective view of the two vertical stiffeners and the two horizontal stiffeners which are incorporated in the preferred embodiment of the present invention.

Referring now to FIGS. 2 and 4, the X-ray attenuating apron of the present embodiment also includes first and second vertical stiffeners 32 and 34. Stiffeners 32 and 34 may be fabricated from plastic, spring steel or an equivalent material and are configured in the inverted "J" form illustrated in FIG. 4. Stiffeners 32 and 34 should have a rigidity which permits them to fully support the weight of shoulder straps 16 and 18.

The X-ray attenuating apron of the present invention also includes a first horizontal stiffener 36 and a second horizontal stiffener 38. Horizontal stiffeners 36 and 38 are fabricated from a plastic or spring steel material of a type which would be suitable for vertical stiffeners 32 and 34. Horizontal stiffeners 36 and 38 are also coupled to the inner surface of apron body section 10 and, in addition, are secured to vertical stiffeners 32 and 34 where the horizontal and vertical stiffeners cross. The rear end surfaces of horizontal stiffeners 36 may be coupled to the ends of vertical stiffeners 32 and 34 to provide a more rigid mechanical support system for the apron of the present invention. Horizontal stiffeners 36 and 38 are shaped into the semi-cylindrical configuration illustrated in FIG. 4 and serve the additional purpose of conforming apron body section 10 to the general shape of the trunk section of a human body. Horizontal stiffeners 36 and 38 thereby both maintain the apron body section 10 in close contact with the wearer's body and form a semi-rigid support structure for the apron of the present invention.

To use the X-ray attenuating apron of the present invention, a wearer dons the apron by spreading apart the outer ends of horizontal stiffeners 36 and 38 and inserting his arms through the shoulder apertures defined by shoulder strap 16 and 18. Tie straps 28 and 30 are then secured to a pair of coupling elements 20 at a vertical level which will cause tie straps 28 and 30 to encircle the wearer's body at a point just above the upper portion of the wearer's hips. The vertical positioning of the apron should also be adjusted at this time so that shoulder straps 16 and 18 are elevated slightly above the wearer's shoulders. This vertical adjustment ensures that the wearer's shoulders do not support a significant amount of the weight of either the shoulder straps or of the apron itself. Tie straps 28 and 30 are then passed behind the back of the wearer and are brought to a point in front of the wearer where they are secured by tying, by a Velcro securing arrangement or by any other equivalent mechanical system for maintaining the two straps in a fixed position on the front side of apron body section 10. If desired, a wearer may fully circle his body with tie straps 28 and 30 and secure them behind his back.

The advantages realized by the unique structure of the present invention are readily apparent. By properly adjusting and securing tie straps 28 and 30 at the proper vertical position, the tie straps encircle apron body section 10 to thereby secure the X-ray attenuating apron of the present invention to the body of the wearer at a vertical position just above the hip area which permits the weight of the apron to be supported by the wearer's hips. The fact that vertical stiffeners 32 and 34 are maintained slightly above the wearer's shoulders causes the weight of shoulder straps 16 and 18 to be transferred through vertical stiffeners 32 and 34 to the wearer's hips. The unique structure of the present invention transfers the weight of the apron body section and shoulder straps through the weight transfer region of the apron to the wearer's hips and substantially lessens shoulder and back fatigue problems commonly encountered when prior art X-ray attenuating garments are worn for more than a short period of time.

In order to better illustrate the advantages of the invention as applied to bullet-proof garments, a preferred embodiment of the bullet-proof garment version of the invention will now be described in detail.

Referring to FIGS. 5 and 6, bullet-proof garment 40 is typically fabricated from a flexible plastic, bullet-proof material such as Dupont Kevlar cloth and includes a first part 42 and a second part 44. Although the bullet-proof garment of the present invention can be divided into first and second parts at a number of different vertical locations in the preferred embodiment of the invention, the bullet-proof garment 40 has been divided such that the first part 42 is substantially coextensive with the upper section of the garment and the second part 44 is substantially coextensive with the lower section of the garment. The upper section of the garment shields a wearer's torso and includes a first aperture 46 and a second aperture 48 for receiving the wearer's arms. The wearer's neck extends through a third aperture designated by reference Number 50. A collar 52 can be displaced between a retracted position depicted in FIG. 5 where it is located substantially flat against the upper section of the bullet-proof garment. FIG. 6 depicts collar 52 displaced into an extended position surrounding the neck of the wearer to partially shield the wearer's neck. A strip of Velcro connective material 54 maintains the two ends of collar 52 coupled together when the collar is displaced into the extended position.

A shoulder guard 56 is coupled in proximity to the first and second apertures and is also fabricated from a flexible bullet-proof material. As indicated in FIG. 6, shoulder guard 56 can be folded into a retracted position to assist in donning upper section 42 of the bullet-proof garment.

A plurality of multi-position fasteners 58 include a first section 60 and a second section 62. Section 60 of fasteners 58 is coupled to an overlapping flap 64. Flap 64 extends several inches beyond the midline 66 of the bullet-proof garment. Although flap 64 has been shown overlapping onto the right section of the wearer's torso, in many cases it may be desirable to reverse the overlapping relationship between flap 64 and garment midline 66 in order to provide a double layer of bullet-proof material centered more directly over the vital cardiac region of the wearer's torso. Whether the bullet-proof garment of the present invention is fabricated as illustrated or in the mirror image version is strictly a matter of choice.

Lower section 44 of the bullet-proof garment is also fabricated from a flexible bullet-proof material such as Dupont Kevlar and is designed such that the uppermost two to four inches of this section telescopes beneath a corresponding length of the lower portion of upper section 42. In the embodiment of the invention depicted, the weight transfer region of the garment is designated generally by reference number 68. The weight transfer region 68 is secured to the wearer's upper hip area by any one of a variety of different securing means. In the embodiment shown in the drawings, securing means 70 takes the form of a notch cut from the upper side section of lower section 44. A lace is routed through a Plurality of eyelets in substantially the same manner as accomplished in laced shoes or womens' girdles. As the lace securing means 70 is tightened, the upper area of lower section 44 is snugly compressed against the wearer's upper hip area to assist in the weight transfer process effected by the present invention.

Referring now to FIGS. 7 and 8, the internal support structure of the bullet-proof garment will now be described in detail. The weight transfer means of the present invention also includes first and second U-shaped vertical stiffeners designated by reference numbers 72 and 74. A horizontal strut 76 is coupled between the upper rear sections of stiffeners 72 and 74 to maintain a fixed position therebetween. A second semi-cylindrical strut 78 is coupled to the front and rear sections of stiffeners 72 and 74 to assist in maintaining a fixed side to side clearance between the stiffeners as well as to maintain a fixed front to rear spacing between the stiffeners. A snap-type fastener 80 is coupled to the front and rear ends of stiffeners 72 and 74.

FIG. 8 illustrates that a cylindrical stiffener 82 is secured to the interior surface of lower section 44 of the bullet-proof garment. Stiffener 82 includes four fasteners 84. Each fastener 84 mates with a fastener 80 and serves to detachably couple together upper section 42 with lower section 44. Cylindrical stiffener 82 includes another fastener 86 which secures the opposing ends of the stiffener together.

The bullet-proof garment of the present invention is typically custom fitted to a particular individual. Both upper section 42 and lower section 44 of the garment are typically worn together. If the wearer requires increased physical mobility, the coupling between upper section 42 and lower section 44 can be disconnected. In this decoupled condition, the weight transfer function of the present invention is lost but wearer mobility is significantly increased.

After donning the entire bullet-proof garment, the wearer tightens the laces of securing means 70 and vertically adjusts the garment so that the maximum amount of the weight of upper section 44 is transferred through weight transfer region 68 onto the wearer's hips. As was the case with the X-ray attenuating apron, vertical stiffeners 72 and 74 transfer a substantial percentage of the weight of upper section 42 of the bullet-proof garment through cylindrical stiffener 82 into lower section 44. Since cylindrical stiffener 82 is located either within or below weight transfer region 58, the weight transferred by stiffeners 72 and 74 to cylindrical stiffener 82 is effectively transferred from the upper section of the bullet-proof garment to the wearer's hips. This weight transfer process substantially decreases wearer fatigue, particularly shoulder and back strain. If the wearer elects to detach lower section 44 of the bullet-proof garment, the weight transfer function of the present invention will be rendered inoperative.

It will be apparent to those skilled in the art that the disclosed bullet-proof garment may be modified in numerous ways and may assume many embodiments other than the preferred forms specifically set out and described above. For example, the bullet-proof garment may be simplified in structure by fabricating it in only a single section and by eliminating the detachability feature depicted in the drawings. Various types of fastening means other than those depicted may be readily substituted for those shown in a manner well known to one of ordinary skill in the art. Accordingly, it is intended by the appended claims to cover all such modifications of the invention which fall within the true spirit and scope of the invention.

I claim:

1. A bullet-proof garment comprising:

a. a garment fabricated from a flexible bullet resistent material and including
   i. an upper section for shielding a wearer's torso including first and second apertures for the wearer's arms and a third aperture for the wearer's neck;
   ii. a lower section for shielding the wearer's hip and thigh areas;
   iii. a weight transfer region positioned adjacent to the wearer's upper hip area;

b. means for securing said weight transfer region to the wearer's upper hip area; and c. means for transferring a substantial amount of the weight of said upper section through the weight transfer region to the wearer's hips, said weight transfer means including first and second U-shaped, vertical stiffeners coupled to said garment and extending upward through the weight transfer region and the upper section of said garment, said first stiffener passing over the wearer's left shoulder and said second stiffener passing over the wearer's right shoulder.

2. The bullet-proof garment of claim 1 wherein each of said stiffeners includes first and second ends and said vest includes front and rear sides.

3. The bullet-proof garment of claim 2 wherein the first ends of said stiffeners are coupled to the front of said garment and the second ends of said stiffeners are coupled to the rear of said garment.

4. The bullet-proof garment of claim 3 further including a strut coupled to said first and second stiffeners to maintain a fixed separation between said first and second stiffeners.

5. The bullet-proof garment of claim 2 wherein the ends of said stiffeners are coupled to said garment below the upper section of said garment.

6. The bullet-proof garment of claim 1 wherein said garment further includes a first shoulder guard coupled in proximity to said first aperture and a second shoulder guard coupled in proximity to said second aperture.

7. The bullet-proof garment of claim 6 wherein said first and second guards are flexibly coupled to said garment.

8. The bullet-proof garment of claim 1 further including a collar coupled to the upper section of said garment in proximity to said third aperture.

9. The bullet-proof garment of claim 8 wherein said collar can be displaced between a retracted position in which said collar is positioned flat against the upper section of said garment and an extended position in which said collar surrounds the neck of the wearer to partially shield the wearer's neck.

10. The bullet-proof garment of claim 1 wherein the garment is divided into first and second detachable parts coupled together by fastening means.

11. The bullet-proof garment of claim 1 wherein said securing means further includes means for compressing said weight transfer region against the wearer's upper hip area.

12. The bullet-proof garment of claim 11 wherein said compression means includes a drawstring.

* * * * *